US007125633B2

(12) United States Patent
Mishra et al.

(10) Patent No.: US 7,125,633 B2
(45) Date of Patent: Oct. 24, 2006

(54) IMAGING MEMBER HAVING A DUAL CHARGE TRANSPORT LAYER

(75) Inventors: Satchidanand Mishra, Webster, NY (US); Houy Jen Yuh, Pittsford, NY (US); Anthony M. Horgan, Pittsford, NY (US); Markus R. Silvestri, Fairport, NY (US); Robert C. Yu, Webster, NY (US); Yuh Tong, Webster, NY (US); Dale Renfer, Webster, NY (US); Kenny-tuan Dinh, Webster, NY (US); Geoff Foley, Fairport, NY (US); Jack Yanus, Webster, NY (US); Timothy Fuller, Pittsford, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/734,380

(22) Filed: Dec. 12, 2003

(65) Prior Publication Data

US 2004/0151999 A1 Aug. 5, 2004

(51) Int. Cl.
*G03G 5/047* (2006.01)

(52) U.S. Cl. ..... 430/58.3; 430/58.65; 430/58.75; 430/58.8; 430/58.85; 430/58.4

(58) Field of Classification Search ..... 430/58.05, 430/58.65, 58.75, 58.85, 58.3, 73.66, 58.8, 430/58.4

See application file for complete search history.

(56) References Cited

U.S. PATENT DOCUMENTS

| | | | | |
|---|---|---|---|---|
| 4,025,341 | A | 5/1977 | Rule | |
| 4,233,384 | A | 11/1980 | Turner et al. | |
| 4,265,990 | A | 5/1981 | Stolka et al. | |
| 4,286,033 | A | 8/1981 | Neyhart et al. | |
| 4,291,110 | A | 9/1981 | Lee | |
| 4,299,897 | A | 11/1981 | Stolka et al. | |
| 4,306,008 | A | 12/1981 | Pai et al. | |
| 4,338,387 | A | 7/1982 | Hewitt | |
| 4,439,507 | A | 3/1984 | Pan et al. | |
| 4,587,189 | A | 5/1986 | Hor et al. | |
| 4,664,995 | A | 5/1987 | Horgan et al. | |
| 4,806,443 | A | 2/1989 | Yanus et al. | |
| 4,988,597 | A | 1/1991 | Spiewak et al. | |
| 5,244,762 | A | 9/1993 | Spiewak et al. | |
| 5,401,615 | A * | 3/1995 | Pai et al. | 430/58.8 |
| 5,830,614 | A | 11/1998 | Pai et al. | |
| 6,338,927 | B1 * | 1/2002 | Inagaki et al. | 430/73 |
| 6,780,554 | B1 * | 8/2004 | Tong et al. | 430/58.8 |
| 2002/0106570 | A1 * | 8/2002 | Kami et al. | 430/58.05 |
| 2004/0126685 | A1 * | 7/2004 | Horgan et al. | 430/58.3 |

OTHER PUBLICATIONS

Diamond, A.S., ed., *Handbook of Imaging Materials, Marcel Dekker*, Inc., NY (1991), pp. 395-396.*
U.S. Provisional Appl. No. 60/433,887, filed on Dec. 16, 2002.*

* cited by examiner

*Primary Examiner*—Janis L. Dote
(74) *Attorney, Agent, or Firm*—Eugene O. Palazzo; Fay, Sharpe, Fagan, Minnich & McKee, LLP

(57) ABSTRACT

An imaging member having a charge transport layer with multiple regions or layers is provided. The charge transport layer includes at least two charge transport layers coated from solutions of different components and concentrations, wherein the second (top) transport layer comprises a lower concentration of different charge transport compound than the first (bottom) charge transport layer. The charge transport compound included in the second (top) charge transport layer is a high mobility hole transport compound. The charge transport compound in each layer is dissolved or molecularly dispersed in an electrically inactive film forming polymer to form a solid solution. In such a construction, the resulting dual charge transport layer exhibits enhanced cracking suppression, improves wear resistance, provides excellent imaging member electrical performance, and delivers improved print quality.

10 Claims, 1 Drawing Sheet

IMAGING MEMBER HAVING A DUAL CHARGE TRANSPORT LAYER

BACKGROUND

Disclosed herein is an imaging member, such as a flexible photoconductive imaging member, comprised of a photogenerating layer, and overlayed thereon, a charge transport layer comprising multiple regions including a first (bottom) charge transport layer and a second (top) charge transport layer. The second or top charge transport layer contains certain effective amounts of high mobility charge transport components to thereby avoid or minimize undesirable bending stress induced cracking of the charge transport layer of the member, wherein such cracking decreases the lifetime function of the member.

An electrophotographic imaging member device comprising at least one photoconductive insulating layer can imaged by uniformly depositing an electrostatic charge on the imaging surface of the electrophotographic imaging member and then exposing the imaging member to a pattern of activating electromagnetic radiation, such as light, which selectively dissipates the charge in the illuminated areas of the imaging member while leaving behind an electrostatic latent image in the non-illuminated areas. This electrostatic latent image may then be developed to form a visible image by depositing finely divided electroscopic marking toner particles on the imaging member surface. The resulting visible toner image can then be transferred to a suitable receiving member such as paper.

A number of current imaging members are, for example, referred to as multilayered photoreceptors that, in a negative charging system, comprise a supporting substrate, an electrically conductive layer, an optional charge blocking layer, an optional adhesive layer, a charge generating layer, a charge transport layer, and an optional protective or overcoating layer. The imaging members of multilayered photoreceptors can take several forms, for example, flexible belts, rigid drums and the like. Flexible photoreceptor belts may either be seamed or seamless belts. An anti-curl layer may, for example, be employed on the back side of the substrate support, opposite to the electrically active layers, to achieve the desired photoreceptor flatness.

Multilayered photoreceptors, when functioning under electrophotographic machine service conditions, do exhibit typical mechanical failures such as frictional abrasion, wear, and surface cracking. Surface cracking frequently seen in belt photoreceptors is induced either due to dynamic fatigue of the belt flexing over the supporting rollers of a machine belt support module or caused by exposure to airborne chemical contaminants such as solvent vapors and corona species emitted by machine charging subsystems while the photoreceptor belt is subjected to bending stress. The cracks start on the surface of the transport layer, propagate through the transport layer and eventually cause the delamination of the cracked transport layer from the generator layer. The charges on the photoreceptor surface leak through the cracks and cause dark lines printed out on the prints. Such a short photoreceptor life profoundly increases the UMR rate and cost. In fact, photoreceptor surface cracking is one of the common and most urgent mechanical problems seen, particularly in flexible belts. This problem requires quick resolution, because the cracks so generated produce printout defects that seriously impact copy quality.

REFERENCES

Electrophotographic imaging members having at least two electrically operative layers including a charge generating layer and a transport layer comprising a diamine are disclosed in U.S. Pat. Nos. 4,265,990, 4,233,384, 4,306,008, 4,299,897 and 4,439,507. The disclosures of these patents are incorporated herein in their entirety.

U.S. Pat. No. 4,265,990 discloses a layered photoreceptor having a separate charge generating (photogenerating) layer and charge transport layer. The charge generating layer is capable of photogenerating holes and injecting the photogenerated holes into the charge transport layer. The photogenerating layer utilized in multilayered photoreceptors includes, for example, inorganic photoconductive particles or organic photoconductive particles dispersed in a film forming polymeric binder. Inorganic or organic photoconductive materials may be formed as a continuous, homogeneous photogenerating layer. The disclosure of this patent is incorporated herein by reference.

U.S. Pat. No. 4,806,443, the disclosure of which is also totally incorporated herein by reference, describes a charge transport layer including a polyether carbonate obtained from the condensation of N,N'-diphenyl-N,N'bis(3-hydroy phenyl)-[1,1'-biphenyl]-4,4'-diamine and diethylene glycol bischloroformate. U.S. Pat. No. 4,025,341 describes a photoreceptor with a charge transport layer including a hole transporting material such as poly(oxycarbonyloxy)-2-methyl-1,4-phenylenecyclohexylidene-3-methyl-1,4-phenylene.

U.S. Pat. No. 4,806,443, the disclosure of which is also totally incorporated herein by reference, describes a charge transport layer including a polyether carbonate obtained from the condensation of N,N'-diphenyl-N,N'-bis(3-hydroxyphenyl)-[1,1'-biphenyl]-4,4'-diamine and diethylene glycol bischloroformate. U.S. Pat. No. 4,025,341 describes a photoreceptor with a charge transport layer including a hole transporting material such as poly(oxycarbonyloxy)-2-methyl-1,4-phenylenecyclohexylidene-3-methyl-1,4-phenylene.

However, notwithstanding the above, there remains a need to provide an improved material for formulating a charge transport layer of an imaging member that exhibits excellent performance properties and which is more tolerant to failures caused by mechanical and electrical stresses, has an enhanced coating thickness uniformity, reduces imaging member surface cracking and extends the functional life of the imaging member.

SUMMARY

Disclosed herein is an imaging member, such as a photoconducting imaging member, having a charge transport layer with multiple regions or layers. The charge transport layer has at least two separately formed charge transport layers or sub-layers that are in contiguous contact with each other. The imaging member possesses a number of the advantages illustrated herein inclusive of excellent performance properties. For example, the member is less susceptible to developing mechanical and electrical stresses, thereby extending the life of the imaging member.

More particularly disclosed herein is an imaging member, such as a flexible photoconductive imaging member, comprised of a photogenerating layer, and overlayed thereon, a charge transport layer comprising at least a first (bottom) charge transport layer and a second (top) charge transport layer. The second (top) layer contains an effective amount of certain charge transport components to thereby avoid or minimize the development of undesirable cracking of the charge transport layer of the member. The charge transport components include charge transport compounds of different mobility which are dissolved or molecularly dispersed in polymer binders to form a solid solution. Such a charge transport layer arrangement results in an increase in the functional service lifetime of the member.

In an alternative embodiment, the development relates to a flexible photoconductive imaging member having a charge transport layer with multiple regions. The charge transport layer comprises at least two layers coated from two different coating solutions, wherein the second charge transport layer (top) comprises a lower concentration or percentage of charge transport materials than the first charge transport layer (bottom). In this embodiment, the bottom or first charge transport layer is in direct contact with the photogenerating layer, and the second charge transport layer is in direct contact with the first charge transport layer. As a result, the first charge transport layer is situated between, and in contiguous contact with, the photogenerating layer and the second charge transport layer.

Moreover, in further embodiments there are also provided flexible photoconductive imaging members with dual charge transport layers, wherein the second or top charge transport layer contains excellent and high mobility charge transport compounds, such as hole transport molecules. In these embodiments the high mobility refers, for example, to at least about 50 percent higher capacity in hole transport mobility than the known aryl amines. Such high mobility hole transport compounds exhibit good compatibility with the resin binder, produce reduced or no crystallization of the hole transport molecules, and increased coating layer robustness to produce enhanced mechanical function of the imaging member top layer. This is particularly true when utilizing reduced amounts of from about 20 to about 40 percent by weight of the high mobility hole transport molecules in the second or top charge transport layer.

The photoconductive imaging member may be a rigid drum design or in flexible belt configuration. For flexible imaging member belt, it can be a seamed belt or a seamless belt. Moreover, for simplicity purposes, the discussions hereinafter will be generally presented with reference to imaging members in a flexible belt configuration.

Processes of imaging, especially xerographic imaging and printing, including digital, are also encompassed by the present disclosure. More specifically, the layered photoconductive imaging members of the present development can be selected for a number of different known imaging and printing processes including, for example, electrophotographic imaging processes, especially xerographic imaging and printing processes wherein charged latent images are rendered visible with toner compositions of an appropriate charge polarity. Moreover, the imaging members of this disclosure are useful in color xerographic applications, particularly high-speed color copying and printing processes and which members are in embodiments sensitive in the wavelength region of, for example, from about 500 to about 900 nanometers, and in particular from about 650 to about 850 nanometers, thus diode lasers can be selected as the light source.

In a still further embodiment, the development relates to imaging members with two overlapping charge transport layers and which members posses a number of the advantages illustrated herein inclusive of excellent performance properties and which members are less susceptible to develop mechanical failure and electrical stresses. This embodiment also provides enhanced coating homogeneity as reflected in less transport molecule crystallization in the coating layer material matrix, suppressing the propensity of early onset of imaging member belt fatigue or chemical vapor exposure induced charge transport layer cracking. The development increases or extends the imaging member belt cyclic service life by almost a two-fold improvement.

Also disclosed herein is a negatively charged electrophotographic imaging member comprising a supporting substrate having an optional conductive surface or layer, an optional hole blocking layer, an optional adhesive layer, a charge generating layer, a dual charge transport layer having a first (bottom) portion or layer and a second (top) portion or layer, each of which is a solid solution comprising a particular hole mobility organic charge transporting compound molecularly dispersed or dissolved in a film forming polymer binder. The hole mobility organic charge transporting compound utilized in the first layer preferably comprises triphenylmethane, bis(4-diethylamine-2-methylphenyl) phenylmethane, stilbene, and hydrazone; otherwise, an aromatic amine comprising tritolylamine; arylamine; enamine; phenanthrene diamine; N,N'-bis-(3,4-dimethylphenyl)-4-biphenyl amine; N,N'-bis-(4-methylphenyl)-N,N'-bis(4-ethylphenyl)-1,1'-(3,3'-dimethylbiphenyl)-4,4'-diamine; 4,4'-bis(diethylamino)-2,2'-dimethyltriphenylmethane; N,N'-diphenyl-N,N'-bis(3-methylphenyl)-[1,1'-biphenyl]-4,4'-diamine; N,N'-diphenyl-N,N'-bis(4-methylphenyl)-1,1'-biphenyl-4,4'-diamine; N,N'-diphenyl-N,N'-bis(alkylphenyl)-1,1'-biphenyl-4,4'-diamine; and N,N'-diphenyl-N,N'-bis(chlorophenyl)-1,1'-biphenyl-4,4'-diamine. For example, included herein are the aromatic diamines that are generally represented by the molecular Formula (I) below:

FORMULA (I)

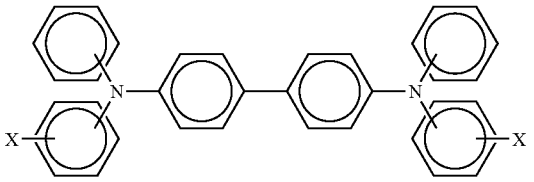

wherein X is selected from the group consisting of alkyl, hydroxy, and halogen. The first (bottom) charge transport layer comprises from about 50 to about 90 weight percent, preferably from about 50 to about 70 weight percent of the hole transporting compound set forth above.

The charge or hole transporting compound incorporated in the second or top charge transport layer comprises charge transporting compounds having enhanced hole transporting capacity (about 50 percent hole mobility improvement) than those aromatic diamines described above. Such a compound is suitable for use in this development because its enhanced hole transport capability will allow for usages of lower concentrations in the top charge transport layer formulation. This will therefore allow for mechanical property improvement without causing deleterious photoelectrical impact to the fabricated imaging member. Examples of such high hole mobility transporting compounds or molecules include the charge transport compounds represented by the molecular Formula (II) below:

FORMULA (II)

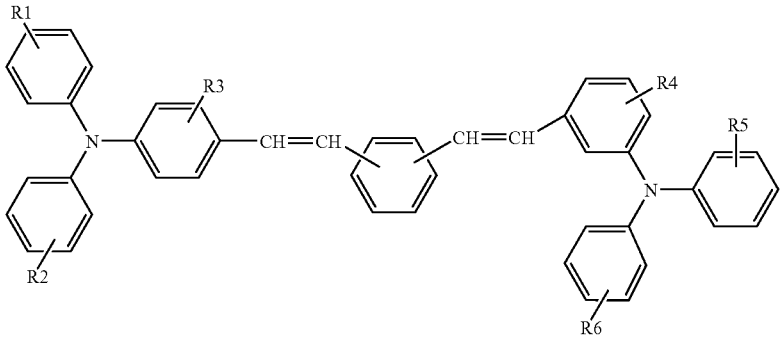

where R1, R2, R3, R4, R5 and R6 are each independently selected from hydrogen, halogen, an alkyl, an aryl, or a cyclo-alkyl group having 1 to 18 carbon atoms. The second (top) charge transport layer comprises a lesser amount of charge transport molecules than the first (bottom) charge transport layer. Preferably, the second (top) charge transport layer comprises between about 20 and about 45 weight percent, more preferably between about 30 and about 40 weight percent, of the high hole mobility transport compounds. The fabricated imaging member may also require an anti-curl layer to be coated onto the back side of the support substrate to render imaging member flatness.

Other aspects of the mechanical function improvements illustrated herein by the charge transport layer relate to an imaging member comprising:

a supporting flexible substrate having a conductive surface or layer, an optional hole blocking layer, an optional adhesive layer, a charge generating layer, and, a dual charge transport layer comprising at least a first (bottom) charge transport layer and a second (top) charge transport layer, both formed from solid solutions comprising a film forming polymer binder and a hole transporting diamine (preferably the binder used is of the same polymer for both layers), wherein the first (bottom) charge transport layer comprises from about 50 to about 90 weight percent, preferably from about 50 to about 70 weight percent, of an aromatic diamine hole transporting compound such as the compound of Formula (I) or any of the aromatic diamines named above, while the second (top) charge transport layer comprises a high hole charge transporting compound such as the diamine of Formula (II) in a lesser amount of between about 20 and about 45 weight percent, but preferably between about 30 and about 40 weight percent. An anti-curl layer may be coated to the back side of the support substrate to provide imaging member flatness.

Still yet another aspect of charge transport layer mechanical function improvement illustrated herein relates to an imaging member comprising, a supporting flexible substrate having a conductive surface or layer, an optional hole blocking layer, an optional adhesive layer, a charge generating layer, a dual charge transport layer including a first (bottom) charge transport layer and a second (top) charge transport layer, both of solid solutions comprising the same film forming polymer binder but with different hole transporting compounds; wherein the first (bottom) charge transport layer comprises from about 50 to about 90, with a preference of between about 50 and about 70, weight percent hole transporting aryl diamine such as the diamine of Formula (I), while the second (top) charge transport layer comprises lesser amount of between 20 and about 45, with optimum result from about 30 to about 40, weight percent of a high hole mobility charge transporting compound such as the diamine hole transporting compound of Formula (II). Optionally, an anti-curl layer may again be included coated to the back side of the support substrate to maintain imaging member flatness.

The top or second charge transporting-layer material may also include, for example, antioxidants in an amount of from about 0.5 to about 15 weight percent, leveling agents in an amount of from about 0.5 to about 5 weight percent surfactants in an amount of from about 0.5 to about 10 weight percent, wear resistant additives such as, polytetrafluoroethylene (PTFE) particles and silica particles dispersion, in an amount of from about 0.5 to about 5 weight percent of light shock resisting or reducing agents, and the like, to impart further photo-electrical, mechanical, and copy print-out quality enhancements.

Still further advantages and benefits of the present exemplary embodiments will become apparent to those of ordinary skill in the art upon reading and understanding the following detailed description of the preferred embodiments.

DETAILED DESCRIPTION

Figure 1:
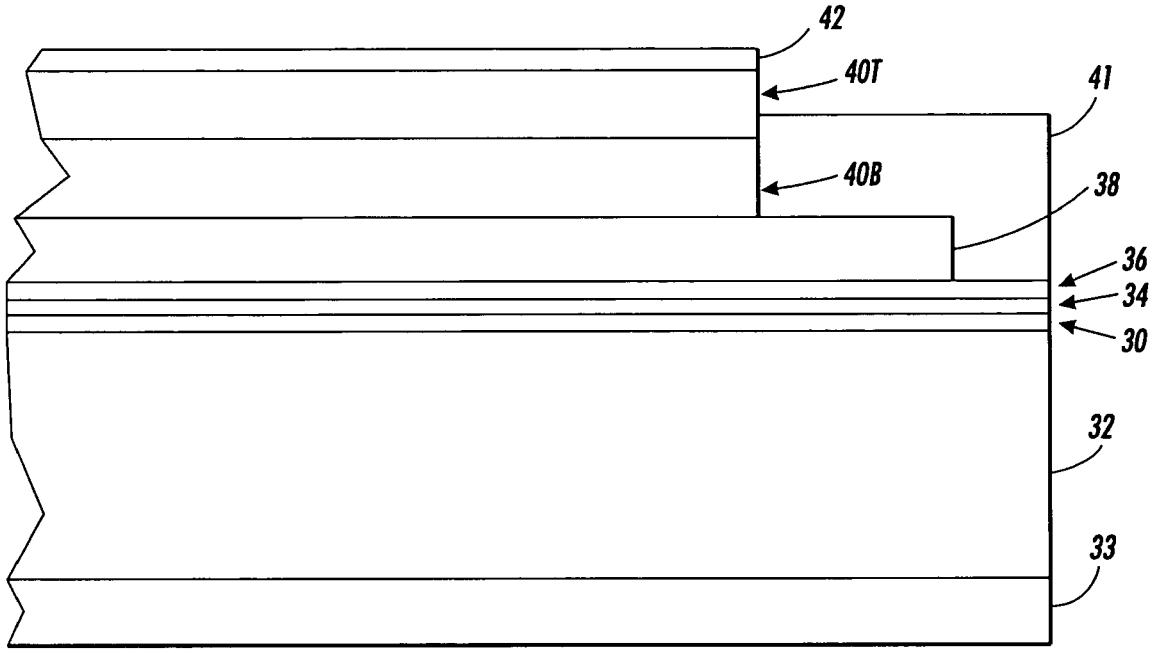
FIG. 1 is a schematic cross-sectional view of an exemplary embodiment of an imaging member of the present development. This figure is merely a schematic representation based on convenience and the ease of demonstrating the present development, and is, therefore, not intended to indicate relative size and dimensions of the imaging member or components thereof and/or to define or limit the scope of the exemplary embodiment.

The imaging member disclosed herein with a dual charge transport layer is comprised of two charge transport layers coated from two different coating solutions. The second or top charge transport layer comprises a lower concentration or percentage of charge transport materials than the first or bottom charge transport layer. The bottom or first layer is in contact with the photogenerating layer and the top or second charge transport layer is in contact with the first charge transport layer. Consequently, the first charge transport layer is situated between the photogenerating layer and the second charge transport layer.

Moreover, there is disclosed herein an imaging member with two charge transport layers, wherein the second or top charge transport layer contains excellent and high mobility charge transport components, such as hole transport molecules. High mobility refers herein to at least about 50 percent higher than the known aryl amines. The high mobility hole transports utilized in the second or top layer are compatible with the resin binder and are present in reduced amounts in comparison to the charge transport components used in the first or bottom layer. This arrangement produces reduced or no crystallization of the hole transport molecules, and increased robustness and mechanical strength of the imaging member top layer, especially when selecting from about 20 to about 40 percent by weight of hole transport molecules in the top or second charge transport layer.

A photoreceptor is disclosed employing the dual charge transport layer. It comprises a support substrate having an optional conductive surface layer, an optional charge or hole blocking layer, an optional adhesive layer, a charge generating layer, an overall dual charge transport layer having two layers or sub-layers, consisting a first charge transport layer and second charge transport layer, and one or more optional overcoat and/or protective layer(s). An exemplary embodiment of this development is illustrated in FIG. 1.

The photoreceptor substrate support 32 may be opaque or substantially transparent, and may comprise any suitable organic or inorganic material having the requisite mechanical properties. The entire substrate can comprise the same material as that in the electrically conductive surface, or the electrically conductive surface can be merely a coating on the substrate. Any suitable electrically conductive material can be employed. Typical electrically conductive materials include copper, brass, nickel, zinc, chromium, stainless steel, conductive plastics and rubbers, aluminum, semitransparent aluminum, steel, cadmium, silver, gold, zirconium, niobium, tantalum, vanadium, hafnium, titanium, nickel, chromium, tungsten, molybdenum, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like.

The substrate 32 can also be formulated entirely of an electrically conductive material, or it can be an insulating material including inorganic or organic polymeric materials, such as, MYLAR®, a commercially available biaxially oriented polyethylene terephthalate from Dupont, MYLAR® with a coated conductive titanium surface, otherwise a layer of an organic or inorganic material having a semiconductive surface layer, such as indium tin oxide, aluminum, titanium, and the like, or exclusively be made up of a conductive material such as, aluminum, chromium, nickel, brass, other metals and the like. The thickness of the support substrate depends on numerous factors, including mechanical performance and economic considerations.

The substrate may be flexible, being a seamed or seamless for flexible photoreceptor belt fabrication or it can be rigid used for imaging member plate design application. The substrate may in fact have a number of many different configurations, such as, for example, a plate, a drum, a scroll, an endless flexible belt, and the like. In one embodiment, the substrate is in the form of a seamed flexible belt.

The thickness of the substrate layer depends on numerous factors, including flexibility, mechanical performance, and economic considerations. The thickness of this support substrate 32 may range from about 50 micrometers to about 3,000 micrometers; and in embodiments of flexible photoreceptor belt preparation, the thickness of substrate 32 is from about 75 micrometers to about 200 micrometers for optimum flexibility and to effect minimum induced photoreceptor surface bending stress when a photoreceptor belt is cycled around small diameter rollers in a machine belt support module, for example, 19 millimeter diameter rollers. The surface of the support substrate is cleaned prior to coating to promote greater adhesion of the deposited coating composition.

When a photoreceptor flexible belt is desired, the thickness of the conductive layer 30 on the support substrate 32, for example, a titanium conductive layer produced by a sputtered deposition process, is typically ranging from about 20 Angstroms to about 750 Angstroms to enable adequate light transmission for proper back erase, and in embodiments from about 100 Angstroms to about 200 Angstroms for an optimum combination of electrical conductivity, flexibility, and light transmission.

A hole blocking layer 34 may then optionally be applied to the substrate. Generally, electron blocking layers for positively charged photoreceptors allow the photogenerated holes in the charge generating layer at the surface of the photoreceptor to migrate toward the charge (hole) transport layer below and reach the bottom conductive layer during the electrophotographic imaging processes. Thus, an electron blocking layer is normally not expected to block holes in positively charged photoreceptors, such as, photoreceptors coated with a charge generating layer over a charge (hole) transport layer.

For negatively charged photoreceptors, any suitable hole blocking layer 34 capable of forming an electronic barrier to prohibit the migration of holes between the adjacent photoconductive layer and the underlying conductive layer, for example, a titanium layer, may be utilized. A hole blocking layer may be needed to effect ground plane hole injection suppression and it is comprised of any suitable material. The charge (hole) blocking layer may include polymers, such as, polyvinylbutyral, epoxy resins, polyesters, polysiloxanes, polyamides, polyurethanes, HEMA, hydroxylpropyl cellulose, polyphosphazine, and the like, or may be nitrogen containing siloxanes or silanes, nitrogen containing titanium or zirconium compounds, such as, titanate and zirconate. Hole blocking layers having a thickness in wide range of from about 50 Angstrom (0.005 micrometer) to about 10 micrometers depending on the type of material chosen for use in a photoreceptor design. Typical hole blocking layer materials are, for example, trimethoxysilyl propylene diamine, hydrolyzed trimethoxysilyl propyl ethylene diamine, N-beta-(aminoethyl) gamma-amino-propyl trimethoxy silane, isopropyl 4-aminobenzene sulfonyl, di(dodecylbenzene sulfonyl) titanate, isopropyl di(4-aminobenzoyl)isostearoyl titanate, isopropyl tri(N-ethylamino-ethylamino)titanate, isopropyl trianthranil titanate, isopropyl tri(N,N-dimethyl-ethylamino)titanate, titanium-4-amino benzene sulfonate oxyacetate, titanium 4-aminobenzoate isostearate oxyacetate, $[H_2N(CH_2)_4]CH_3Si(OCH_3)_2$, gamma-aminobutyl) methyl diethoxysilane, and $[H_2N(CH_2)_3]CH_3Si(OCH_3)_2$, (gamma-aminopropyl)-methyl diethoxysilane, as disclosed in U.S. Pat. Nos. 4,338,387, 4,286,033 and 4,291,110. Other suitable charge blocking layer polymer compositions are also described in U.S. Pat. No. 5,244,762. These include vinyl hydroxyl ester and vinyl hydroxy amide polymers wherein the hydroxyl groups have been partially modified to benzoate and acetate esters which modified polymers are then blended with other unmodified vinyl hydroxy ester and amide unmodified polymers. An example of such a blend is a 30 mole percent benzoate ester of poly (2-hydroxyethyl methacrylate) blended with the parent polymer poly (2-hydroxyethyl methacrylate). Still other suitable charge blocking layer polymer compositions are described in U.S. Pat. No. 4,988,597. These include polymers containing an alkyl acrylamidoglycolate alkyl ether repeat unit. An example of such an alkyl acrylamidoglycolate alkyl ether containing polymer is the copolymer poly(methyl acrylamidoglycolate methyl ether-co-2-hydroxyethyl methacrylate). The disclosures of the U.S. Patents are incorporated herein by reference in their entirety.

The hole blocking layer 34 is continuous and may have a thickness of less than about 10 micrometers because greater thicknesses may lead to undesirably high residual voltage. In embodiments, a blocking layer of from about 0.005 micrometers to about 1.5 micrometers facilitates charge neutralization after the exposure step and optimum electrical performance is achieved. The blocking layer may be applied by any suitable conventional technique, such as, spraying, dip coating, draw bar coating, gravure coating, silk screening, air knife coating, reverse roll coating, vacuum deposition, chemical treatment, and the like. For convenience in obtaining thin layers, the blocking layer is, in embodiments, applied in the form of a dilute solution, with the solvent being removed after deposition of the coating by conventional techniques, such as, by vacuum, heating, and the like. Generally, a weight ratio of blocking layer material and solvent of between about 0.05:100 to about 5:100 is satisfactory for spray coating.

Any suitable technique may be utilized to apply the optional adhesive layer coating 36. Typical coating techniques include extrusion coating, gravure coating, spray coating, wire wound bar coating, and the like. The adhesive layer is applied directly to the hole blocking layer. Thus, the adhesive layer in embodiments is in direct contiguous contact with both the underlying hole blocking layer and the overlying charge generating layer to enhance adhesion bonding to provide linkage. Drying of the deposited wet adhesive coating may be effected by any suitable conventional process such as oven drying, infra red radiation drying, air drying, and the like. In embodiments, the adhesive layer is continuous. Satisfactory results are achieved when the adhesive layer has a thickness of from about 0.01 micrometers to about 2 micrometers after drying. In embodiments, the dried thickness is from about 0.03 micrometers to about 1 micrometer. At thicknesses of less than about 0.01 micrometers, the adhesion between the charge generating layer and the blocking layer is poor and delamination can occur when the photoreceptor belt is transported over small diameter supports such as rollers and curved skid plates. When the thickness of the adhesive layer is greater than about 2 micrometers, excessive residual charge buildup is observed during extended cycling.

The components of the photogenerating layer 38 comprise photogenerating particles for example, of Type V hydroxygallium phthalocyanine, x-polymorph metal free phthalocyanine, or chlorogallium phthalocyanine photogenerating pigments dispersed in a matrix comprising an arylamine hole transport molecules and certain selected electron transport molecules. Selenium, selenium alloy, benzimidazole perylene, and the like and mixtures thereof may be formed as a continuous, homogeneous photogenerating layer. Benzimidazole perylene compositions are well known and described, for example in U.S. Pat. No. 4,587,189, the entire disclosure thereof being incorporated herein by reference. Multi-photogenerating layer compositions may be utilized where a photoconductive layer enhances or reduces the properties of the photogenerating layer. Other suitable photogenerating materials known in the art may also be utilized, if desired.

Any suitable charge generating binder layer comprising photoconductive particles dispersed in a film forming binder may be utilized. Photoconductive particles for charge generating binder layer such vanadyl phthalocyanine, metal free phthalocyanine, benzimidazole perylene, amorphous selenium, trigonal selenium, selenium alloys, such as, selenium-tellurium, selenium-tellurium-arsenic, selenium arsenide, and the like and mixtures thereof are used in specific embodiments because of their sensitivity to white light. Vanadyl phthalocyanine, metal free phthalocyanine and tellurium alloys are used, for example, to provide the additional benefit of being sensitive to infrared light. The photogenerating materials selected should be sensitive to activating radiation having a wavelength between about 600 nanometers and about 700 nanometers during the imagewise radiation exposure step in an electrophotographic imaging process to form an electrostatic latent image. Type V hydroxygallium phthalocyanine may be prepared by hydrolyzing a gallium phthalocyanine precursor including dissolving the hydroxygallium phthalocyanine in a strong acid and then reprecipitating the resulting dissolved precursor in a basic aqueous media; removing any ionic species formed by washing with water; concentrating the resulting aqueous slurry comprising water and hydroxygallium phthalocyanine as a wet cake; removing water from the wet cake by drying; and subjecting the resulting dry pigment to mixing with a second solvent to form the Type V hydroxygallium phthalocyanine. These pigment particles in embodiments have an average particle size of less than about 5 micrometers.

The photogenerating layer 38 containing photoconductive compositions and/or pigments and the resinous binder material generally ranges in thickness of from about 0.1 micrometers to about 5.0 micrometers, and in embodiments has a thickness of from about 0.3 micrometers to about 3 micrometers. Thicknesses outside of these ranges can be selected. The photogenerating layer thickness is generally related to binder content. Thus, for example, higher binder content compositions generally result in thicker layers for photogeneration.

Any suitable film forming binder may be utilized in the photoconductive insulating layer. Examples of suitable binders for the photoconductive materials include thermoplastic and thermosetting resins, such as, polycarbonates, polyesters, including polyethylene terephthalate, polyurethanes, polystyrenes, polybutadienes, polysulfones, polyarylethers, polyarylsulfones, polyethersulfones, polycarbonates, polyethylenes, polypropylenes, polymethylpentenes, polyphenylene sulfides, polyvinyl acetates, polyvinylbutyrals, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchlorides, polyvinyl alcohols, poly-N-vinylpyrrolidinone)s, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, polyvinylcarbazoles, and the like. These polymers may be block, random or alternating copolymers.

Specific electrically inactive binders include polycarbonate resins with a weight average molecular weight of from about 20,000 to about 100,000. In embodiments, a weight average molecular weight of from about 50,000 to about 100,000 is specifically selected. More specifically, excellent imaging results are achieved with poly(4,4'-diphenyl-1,1'-cyclohexane carbonate) polycarbonate; poly(4,4'-diphenyl-1,1'-cyclohexane carbonate-500, with a weight average molecular weight of 51,000; or poly(4,4'-diphenyl-1,1'-cyclohexane carbonate-400, with a weight average molecular weight of 40,000.

The photogenerating binder layer containing photoconductive compositions and/or pigments, and the resinous binder material in embodiments, ranges in thickness of from about 0.1 micrometers to about 5.0 micrometers, and has an optimum thickness of from about 0.3 micrometers to about 3 micrometers for best light absorption and improved dark decay stability and mechanical properties.

When the photogenerating material is present in the binder material, the photogenerating composition or pigment may be present in the film forming polymer binder compositions in any suitable or desired amounts. For example, from about 10 percent by volume to about 60 percent by volume of the photogenerating pigment may be dispersed in from about 40 percent by volume to about 90 percent by volume of the film forming polymer binder composition, and in embodiments from about 20 percent by volume to about 30 percent by volume of the photogenerating pigment may be dispersed in about 70 percent by volume to about 80 percent by volume of the film forming polymer binder composition. Typically, the photoconductive material is present in the photogenerating layer in an amount of from about 5 to about 80 percent by weight, and in embodiments from about 25 to about 75 percent by weight, and the binder is present in an amount of from about 20 to about 95 percent by weight, and in embodiments from about 25 to about 75 percent by weight, although the relative amounts can be outside these ranges.

Any suitable technique may be utilized to mix and thereafter apply the photogenerating layer coating mixture. Typical application techniques include spraying, dip coating, roll coating, wire wound rod coating, and the like. Drying of the deposited coating may be effected by any suitable technique, such as oven drying, infra red radiation drying, air drying, and the like.

The layers or sub-layers of the overall dual charge transport layer 40 of the flexible photoreceptor belt may comprise any suitable transparent organic polymer or non-polymeric material capable of supporting the injection of photogenerated holes or electrons from the charge generating layer and allowing the transport of these holes or electrons through the organic layer to selectively discharge the surface charge. The charge transport layer not only serves to transport holes, but also protects the photoconductive layer from abrasion or chemical attack.

The layers or sub-layers (40B and 40T) of the overall dual charge transport layer are normally transparent in a wavelength region in which the electrophotographic imaging member is to be used when exposure is effected therethrough to ensure that most of the incident radiation is utilized by the underlying charge generating layer. Each charge transport layer should exhibit excellent optical transparency with negligible light absorption and neither charge generation nor discharge if any, when exposed to a wavelength of light useful in xerography, e.g., 4000 to 9000 Angstroms. In the case when the photoreceptor is prepared with the use of a transparent substrate and also a transparent conductive layer, imagewise exposure or erase may be accomplished through the substrate with all light passing through the back side of the substrate. In this case, the materials of the layers or sub-layers 40B and 40T of the overall dual charge transport layer need not transmit light in the wavelength region of use if the charge generating layer is sandwiched between the substrate and the charge transport layer. The dual charge transport layer in conjunction with the charge generating layer 38 is an insulator to the extent that an electrostatic charge placed on the charge transport layer is not conducted in the absence of illumination. The first or bottom charge transport layer 40B and the second or top charge transport layer 40T which make up the dual charge transport layer should trap minimal charges as the case may be passing through it. Charge transport layer materials are well known in the art.

The charge transport layer(s) may comprise activating compounds or charge transport compounds molecularly dispersed or dissolved in normally, electrically inactive film forming polymeric materials to form a solid solution and thereby making these coating layers electrically active. To create a functional charge transport layer, it is required that charge transport molecules be added to a polymeric matrix to make it electrically active, since the polymer material is itself inherently incapable of supporting the injection of photogenerated holes and incapable of allowing the transport of these holes through it.

Although the film forming polymer binder used may be of different materials in either charge transport layer, nonetheless it is preferable to have identical polymer binder in both top and bottom charge transport layers for the benefit of providing excellent interfacial adhesion bonding between these two layers.

The polymer binder used for the charge transport layers may be, for example, selected from the group consisting of polycarbonates, poly(vinyl carbazole), and polystyrene. It is, however, preferred to use polycarbonate, especially a poly (4,4'-isopropylidene diphenyl carbonate) or a poly(4,4'-diphenyl-1,1'-cyclohexane carbonate).

In one embodiment, the charge transport layer is of a dual-layer construction in which both layers are of the same thickness and comprise the same polymer binder. The hole transporting compound incorporated in the first or bottom charge transport layer 40T is an aryl diamine hole transporting compound such as the aryl diamine hole transporting compound represented by:

FORMULA (I)

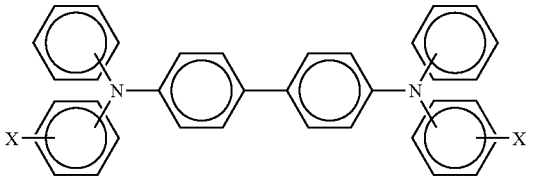

wherein X is selected from the group consisting of alkyl, hydroxy, and halogen. The first (bottom) charge transport layer comprises from about 50 to about 90 percent by weight of this aryl diamine.

The second (top) charge transport layer 40T comprises a lesser amount of between about 20 and about 45 weight percent of high mobility charge transport compounds such as the high mobility hole diamine set forth below in Formula (II). This results in effective suppression of charge transport layer cracking problem and thereby provides effectual extension of the photoreceptor belt mechanical functioning life in the field. The reason that the second or top charge transport layer needs a lesser amount of the novel diamine loading is due to the fact that the diamine has a hole mobility capacity 2 times greater than that of the typical aromatic diamine counterpart, so it will require a lesser quantity to effect the same imaging member photo-electrical functioning outcome. The molecular formula of the high hole transporting diamine is represented by:

FORMULA (II)

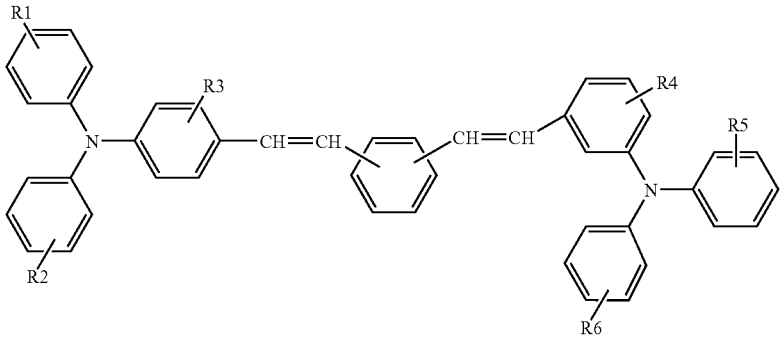

where R1, R2, R3, R4, R5, and R6 are each independently selected from hydrogen, halogen, an alkyl, an aryl, or a cyclo-alkyl group having 1 to 18 carbon atoms.

For producing more optimum results, the content of charge transport compound in the dual charge transport layer of this embodiment is between about 50 and about 70 weight percent in the first (bottom) charge transport layer 40B, and between 30 and 40 weight percent in the second (top) charge transport layer 40T.

The embodiments given in the above precedings describe both first (bottom) and second (top) charge transport layer utilizing the same film forming polymer binder. Nevertheless, the film forming polymer used for formulating each of the dual charge transport layer in this disclosure may otherwise include any different materials which are capable of forming a solid solution with the charge transport compound.

For exemplary purposes only, a typical dual charge transport layer is a solid solution including an activating organic compound molecularly dispersed or dissolved in a preferred polycarbonate binder of being either a poly(4,4'-isopropylidene diphenyl carbonate) or a poly(4,4'-diphenyl-1,1'-cyclohexane carbonate). The prepared dual charge transport layer generally has a Young's Modulus of about $3.5\times10^5$ psi and also with a thermal contraction coefficient of about $7\times10^{-5}$/° C. Each of the dual charge transport layer has a glass transition temperature Tg of between about 75° C. and about 100° C.

The dried dual charge transport layer (consisting of both bottom and top layers), in embodiments, has a total thickness of from about 10 to about 100 micrometers and more specifically, from about 20 micrometers to about 60 micrometers. Although both top and bottom layers may be of different thickness (with bottom layer 40B being not more than 50% thicker than that of the top layer 40T), nevertheless it is preferred that both layers have the same thickness. In general, the ratio of the thickness of the dual charge transport layer to the charge generating layer is, in embodiments, maintained at from about 2:1 to about 200:1, and in specific embodiments, as great as about 400:1.

The total solid to total solvent or solvents used for each of the dual transporting layer coating solution preparation may for example, be around about 10:90 weight percent to about 30:70 weight percent, and in embodiments from about 15:85 weight percent to about 25:75 weight percent. The components may be added together in any suitable order, although the solvent system, in embodiments, is added to the vessel first. The transport molecule binder polymer may be dissolved together or separately and then combined with the solution in the vessel. Once all of the components have been added to the vessel, the solution may be mixed to form a uniform coating composition.

In embodiments, the bottom charge transport layer 40B may be formed directly upon a charge generating layer 38. Any suitable technique may be utilized to apply the charge transport layer coating solution to the photoreceptor structure. Typical application techniques include, for example, spraying, dip coating, extrusion coating, roll coating, wire wound rod coating, draw bar coating, and the like.

Examples of electrophotographic imaging members or photoreceptors having at least two electrically operative layers, including a charge generator layer and diamine containing transport layer, are disclosed in U.S. Pat. No. 5,830,614, U.S. Pat. No. 4,265,990, U.S. Pat. No. 4,233,384, U.S. Pat. No. 4,306,008, U.S. Pat. No. 4,299,897 and U.S. Pat. No. 4,439,507, the disclosures thereof being incorporated herein in their entirety.

Any suitable and conventional technique may be utilized to prepare each of the two charge transport layer coating solutions and thereafter apply the bottom charge transport layer 40B coating solution first onto the charge generating layer 38. Typical application techniques include extrusion coating, spraying, roil coating, wire wound rod coating, and the like. Drying of the deposited coating may be effected by any suitable conventional technique such as oven drying, infra red radiation drying, air drying and the like. The top charge transport layer 40T is then subsequently coated over in the same manner as described to give dual charge transport layer.

If desired, the top charge transport layer 40T composition in each of the photoreceptors, described in the above embodiments, may also include for example, additions of antioxidants, leveling agents, surfactants, wear resistant fillers such as dispersion of polytetrafluoroethylene (PTFE) particles and silica particles, light shock resisting or reducing agents, and the like, to impart further photo-electrical, mechanical, and copy print-out quality enhancement outcomes.

Other layers such as conventional ground strip layer 41 including, for example, conductive particles dispersed in a film forming binder may be applied to one edge of the imaging member to promote electrical continuity with the conductive layer 30 through the hole blocking layer 34, and adhesive layer 36. Ground strip layer 41 may include any suitable film forming polymer binder and electrically conductive particles. Typical ground strip materials include those enumerated in U.S. Pat. No. 4,664,995, the entire disclosure of which is incorporated by reference herein. The ground strip layer 41 may have a thickness from about 7 micrometers to about 42 micrometers, and more specifically from about 14 micrometers to about 23 micrometers.

Optionally, an overcoat layer 42, if desired, may also be utilized to provide imaging member surface protection as well as improve resistance to abrasion.

Since the dual charge transport layer has a great thermal contraction mismatch compared to that of the substrate support 32, the prepared flexible electrophotographic imaging member is, at this point, seen to exhibit spontaneous upward curling due to the result of larger dimensional contraction in the dual charge transport layer than the substrate support 32, as the imaging member cools down to room ambient temperature after the heating/drying processes of the applied wet charge transport layer coating. An anti-curl layer 33 is then necessary to be applied to the back side of the substrate support 32 (which is the side opposite the side bearing the electrically active coating layers) in order to render flatness and thereby complete the imaging member material package.

The anti-curl layer 33 may include any suitable organic or inorganic film forming polymers that are electrically insulating or slightly semi-conductive. In the embodiments, the material make-up of the anti-curl layer of the imaging member is formulated to impact cost saving benefit as well as to provide mechanical robust belt function under normal electrophotographic imaging machine operational conditions. The formulated anti-curl layer 33 has a thermal contraction coefficient value substantially greater than that of the substrate support 32 used in the imaging member within a temperature range between about 20° C. and about 130° C. employed during imaging member fabrication layer coating and drying processes. To yield the designed imaging member flatness outcome, the applied anti-curl layer has a thermal contraction coefficient of at least about 1½ times greater than that of the substrate support to be considered satisfactory; that is a value of at least approximately $+1\times10^{-5}$/° C. larger than the substrate support which typically has a substrate support thermal contraction coefficient of about $2\times10^{-5}$/° C. However, an anti-curl layer with a thermal contraction coefficient at least about 2 times greater, equivalent to about $+2\times10^{-5}$/° C., than that of the substrate support is appropriate to yield an effective anti-curling result. The applied anti-curl layer is a film forming thermoplastic polymer, being optically transparent, with a Young's Modulus of at least about $3\times10^{5}$ psi, bonded to the substrate support to give at least about 15 gms/cm of 180° peel strength, and having a Tg of at least about 75° C. The anti-curl back coating is typically between about 7 and about 20 weight percent based on the total weight of the imaging member which corresponds to from about 7 to about 20 micrometers in coating thickness. The selected anti-curl layer polymer is to be conveniently dissolved in any common organic solvent for the ease of coating solution preparation and is to be inexpensive, so as to provide effectual imaging member production cost cutting.

The selection of a thermoplastic film forming thermoplastic polymer for the anti-curl layer application should satisfy the physical, mechanical, optical, and thermal requirements, as detailed herein. Suitable polymer materials for use in the anti-curl back coating include: polycarbonates, polystyrenes, polyesters, polyamides, polyurethanes, polyarylethers, polyarylsulfones, polyarylate, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloridevinylchloride copolymers, vinylacetate-vinylidenechloride copolymers, styrene-alkyd resins, and the like. These polymers may be block, random or alternating copolymers. In addition, other polymers may also include polycarbonate resin, polyvinylcarbazole, polyester, polyarylate, polyacrylate, polyether, polysulfone, polystyrene, polyamide, and the like. Molecular weights can vary from about 20,000 to about 150,000. Polycarbonates may be a bisphenol A polycarbonate material such as poly(4,4'-isopropylidene-diphenylene carbonate) having a molecular weight of from about 35,000 to about 40,000, available as LEXAN 145 from General Electric Company and poly(4,4'-isopropylidene-diphenylene carbonate) having a molecular weight of from about 40,000 to about 45,000, available as LEXAN 141 also from the General Electric Company. A bisphenol A polycarbonate resin having a molecular weight of from about 50,000 to about 120,000, is available as MAKROLON from Farbenfabricken Bayer A.G. A lower molecular weight bisphenol A polycarbonate resin having a molecular weight of from about 20,000 to about 50,000 is available as MERLON from Mobay Chemical Company. Another type of polycarbonate of interest is poly(4,4-diphenyl-1,1'-cyclohexane carbonate), which is a film forming thermoplastic polymer structurally modified from bisphenol A polycarbonate; it is commercially available from Mitsubishi Chemicals. All of these polycarbonates have a Tg of between about 145° C. and about 165° C. and with a thermal contraction coefficient ranging from about $6.0\times10^{-5}$/° C. to about $7.0\times10^{-5}$/° C.

The anti-curl layer may alternatively be formed from a polymer blend including 2 or more compatible materials of any of the polymers listed above. Furthermore, suitable film forming thermoplastic polymers for the anti-curl layer 33, if desired, may include the binder polymer or polymers used in the dual charge transport layer.

The anti-curl layer 33 formulation may also include the addition of a small quantity of a saturated copolyester adhesion promoter to enhance its adhesion bond strength to the substrate support 32. Typical copolyester adhesion promoters are VITEL polyesters from Goodyear Rubber and Tire Company, MOR-ESTER from Morton Chemicals, EASTAR PETG from Eastman Chemicals, and the like. To impart optimum wear resistance as well as maintaining the coating layer optical clarity, the anti-curl layer may further be incorporated into its material matrix, with about 5 to about 30 weight percent filler dispersion of silica particles, Teflon particles, $PVF_2$ particles, stearate particles, aluminum oxide particles, titanium dioxide particles or a particle blend dispersion of Teflon and any of these inorganic particles. Suitable particles used for dispersion in the anti-curl back coating include particles having a size of between about 0.05 and about 0.22 micrometers, and more specifically between about 0.18 and about 0.20 micrometers.

The fabricated multilayered, flexible photoreceptor having the present disclosure embodiments may be cut into rectangular sheets and converted into photoreceptor belts. The two opposite edges of each photoreceptor cut sheet are then brought together by overlapping and may be joined by any suitable means including ultrasonic welding, gluing, taping, stapling, and pressure and heat fusing to form a continuous imaging member seamed belt, sleeve, or cylinder, nevertheless, from the viewpoint of considerations such as ease of belt fabrication, short operation cycle time, and mechanical strength of the fabricated joint, the ultrasonic welding process is more specifically used to join the overlapping edges into a flexible imaging member seamed belt. The prepared flexible photoreceptor belt may therefore be employed in any suitable and conventional electrophotographic imaging process which utilizes uniform negative charging prior to imagewise exposure to activating electromagnetic radiation. When the imaging surface of an electrophotographic member is uniformly charged with an electrostatic charge and imagewise exposed to activating electromagnetic radiation, conventional positive or reversal development techniques may be employed to form a marking material image on the imaging surface of the photoreceptor belt of this disclosure. Thus, by applying a suitable electrical bias and selecting toner having the appropriate polarity of electrical charge, one may form a toner image in the charged areas or discharged areas on the imaging surface of the electrophotographic member of the present development. For example, for positive development, charged toner particles are attracted to the oppositely charged electrostatic areas of the imaging surface and for reversal development, charged toner particles are attracted to the discharged areas of the imaging surface.

The photoreceptor belt prepared according to the present disclosure may be employed in any suitable and conventional imaging process which utilizes uniform charging prior to imagewise exposure to activating electromagnetic radiation. When the imaging surface of an electrophotographic member is uniformly charged with an electrostatic charge and imagewise exposed to activating electromagnetic radiation. Conventional positive or reversal development techniques may be employed to form a marking material image on the imaging surface of the photoreceptor belt of this disclosure. Thus, by applying a suitable electrical bias and selecting toner having the appropriate polarity of electrical charge, one may form a toner image in the charged areas or discharged areas on the imaging surface of the electrophotographic member of the present development. For example, for positive development, charged toner particles are attracted to the oppositely charged electrostatic areas of the imaging surface and for reversal development, charged toner particles are attracted to the discharged areas of the imaging surface.

Various embodiments of this disclosure will further be illustrated in the following non-limiting examples, it being understood that these examples are intended to be illustrative only and that the development is not intended to be limited to the materials, conditions, process parameters and the like recited herein. All proportions are by weight unless otherwise indicated.

COMPARATIVE EXAMPLE

A comparative electrophotographic imaging member web stock was prepared by providing a 0.02 micrometers thick titanium layer coated on a biaxially oriented polyethylene naphthalate substrate (KADALEX, available from ICI Americas, Inc.) having a thickness of 3.5 micrometers (89 micrometers). Applied thereto, using a gravure coating technique, was a hole blocking layer generated from a solution containing 10 grams of gamma aminopropyltriethoxy silane, 10.1 grams of distilled water, 3 grams of acetic acid, 684.8 grams of 200 proof denatured alcohol and 200 grams of heptane. This layer was then allowed to dry for 5 minutes at 135 degrees Celsius (Centigrade) in a forced air oven. The resulting blocking layer had an average dry thickness of 0.05 micrometers measured with an ellipsometer.

An adhesive interface layer was then prepared by applying with extrusion process to the blocking layer a wet coating containing 5 percent by weight based on the total weight of the solution of polyester adhesive (MOR-ESTER 49,000, available from Morton International, Inc.) in a 70:30 volume ratio mixture of tetrahydrofuranlcyclohexanone. The adhesive interface layer was allowed to dry for 5 minutes at 135 degrees Celsius in the forced air oven. The resulting adhesive interface layer had a dry thickness of 0.065 micrometers.

The adhesive interface layer was thereafter coated with a photogenerating layer. The photogenerating layer dispersion was prepared by introducing 0.45 grams of IUPILON 200, a polycarbonate of poly(4,4'-diphenyl)-1,1'-cyclohexane carbonate (PC-z 200) available from Mitsubishi Gas Chemical Corp and 50 ml of tetrahydrofuran into a 4 oz. glass bottle. To this solution was added 2.4 grams of hydroxygallium phthalocyanine and 300 grams of ⅛ inch (3.2 millimeters) diameter stainless steel shot. This mixture was then placed on a ball mill for 20 to 24 hours. Subsequently, 2.25 grams of PC-z 200 was dissolved in 46.1 grams of tetrahydrofuran, added to the hydroxygallium phthalocyanine slurry. This slurry was then placed on a shaker for 10 minutes. The resulting slurry was, thereafter, coated onto the adhesive interface by extrusion application process to form a layer having a wet thickness of 0.25 micrometers. However, a strip about 10 millimeters wide along one edge of the substrate web bearing the blocking layer and the adhesive layer was deliberately left uncoated by any of the photogenerating layer material to facilitate adequate electrical contact by the ground strip layer that was applied later. This photogenerating layer was dried at 135 degrees Celsius for 5 minutes in a forced air oven to form a dry thickness photogenerating layer having a thickness of 0.4 micrometers.

This coated imaging member web was simultaneously overcoated with a charge transport layer and a ground strip layer using extrusion co-coating process. The charge transport layer was prepared by introducing into an amber glass bottle a weight ratio of 1:1 N,N'-diphenyl-N,N'-bis(3-methylphenyl)-1,1'-biphenyl-4 4'-diamine, which is represented by:

FORMULA (I)

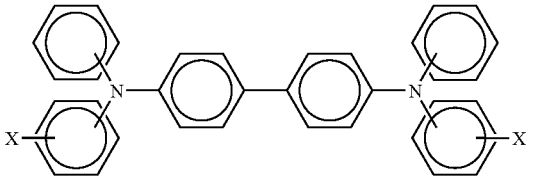

wherein X is methyl group attached to the meta position, and MAKROLON 5705, a bisphenol A polycarbonate, poly(4,4'-isopropylidene diphenyl) carbonate, or poly(4,4'-diphenyl)-1,1'-cyclohexane carbonate of MAKROLON having a weight average molecular weight of about 120,000 commercially available from Bayer A.G. The resulting mixture was dissolved to give a 15 weight percent solids, in 85 weight percent methylene chloride. This solution was applied onto the photogenerator layer to form a coating which upon drying gave a dried charge transport layer thickness of 29 micrometers.

The approximately 10 millimeter wide strip of the adhesive layer left uncoated by the photogenerator layer was coated over with a ground strip layer during the co-coating process. This ground strip layer, after drying along with the co-coated charge transport layer at 135 degrees Celsius in the forced air oven for 5 minutes, had a dried thickness of about 19 micrometers. This ground strip was electrically grounded, by conventional means such as a carbon brush contact means during conventional xerographic imaging process.

An anticurl layer coating was prepared by combining 8.82 grams of polycarbonate resin (MAKROLON 5705, available from Bayer AG), 0.72 grams of polyester resin (VITEL PE-200, available from Goodyear Tire and Rubber Company) and 90.1 grams of methylene chloride in a glass container to form a coating solution containing 8.9 weight percent solids. The container was covered tightly and placed on a roll mill for about 24 hours until the polycarbonate and polyester were dissolved in the methylene chloride to form the anticurl coating solution. The anticurl coating solution was then applied to the rear surface (side opposite the photogenerator layer and charge transport layer) of the imaging member web stock, again by extrusion coating process, and dried at 135 degrees Celsius for about 5 minutes in the forced air oven to produce a dried film thickness of about 17 micrometers.

CONTROL EXAMPLE

An electrophotographic imaging member web was prepared by following the exact same procedures and using the same materials as those described in Comparative Example, but with the exception that the single 29-micrometer thick charge transport layer was replaced by a dual-layer consisting of a 15 micrometers bottom charge transport layer and a 14 micrometers top charge transport layer, with both layers having same weight ratio of 1:1 N,N'-diphenyl-N,N'-bis(3-methylphenyl)-1,1'-biphenyl-4,4'-diamine and MAKROLON 5705 (equivalent to 50 weight percent of hole transport compound and 50 weight percent polymer binder). It is worth noting that the applied bottom charge transport layer was dried prior to the subsequent application of the top charge transport layer.

Example I

Six charge transport layer solutions were prepared according to the procedures described in the Comparative Example, except that the solutions contain varying concentration of charge transport compound N,N'-diphenyl-N,N'-bis(3-methylphenyl)-1,1'-biphenyl-4,4'-diamine of formula (I). When each was coated over a releasing surface of a thick polyvinyl fluoride substrate and dried at 135 degrees Celsius to remove the methylene chloride layer, six dried charge transport layers, containing 50, 40, 30, 20, 10, and 0 weight percent charge transport compound respectively in the MAKROLON binder based on the total weight of each resulting charge transport layer, were obtained. The resulting six dried charge transport layers obtained were each 29 micrometers in thickness.

Mechanical properties measurements carried out for these five standing layers show that reducing the charge transport compound increases break elongation and break stress of the charge transport layer; resulting in a ductile flexible layer as the loading level of the transport compound is reduced. For example, break elongation of the charge transport layer was seen to monotonously increase from 3.5, 7, 11, 16, 65 and 100 percent with respect to 50, 40, 30, 20, 10 and 0 weight percent charge transport compound loadings in the layer material matrix. The results obtained indicated that the charge transport layer was effectively transformed from being a virtually brittle film into a ductile flexible layer, as the loading level of the transport compound was reduced from 50 to 20 weight percent.

Example II

To demonstrate the mechanical impact on a charge transport layer in the imaging member, five electrophotographic imaging members were prepared according to the procedures and using the same material as that described in the Comparative Example, with the exception that the N,N'-diphenyl-N,N'-bis(3-methylphenyl)-1,1'-biphenyl-4,4'-diamine of formula (I) content in the charge transport layer was varied to give respective 50, 40, 30, 20, and 10 weight percent in the MAKROLON binder based on the total weight of each resulting charge transport layer. The imaging members were cut to give 1 inch×6 inch samples and each subjected to low speed sample tensile elongation, using an Instron Mechanical Tester, to determine the exact extent of stretching at which onset of charge transport layer cracking became evident by sample examination under 100× magnification with a stereo optical microscope. The charge transport layer cracking strains were 3.25, 6.5, 10.5, 15.5, and about 64 percent for the corresponding imaging members having 50, 40, 30, 20, and 10 weight percent loaded charge transport layer. The mechanical property enhancement in the charge transport layer was again observed in the imaging members having reduced transport compound loading levels, supporting the mechanical property improvement seen in Example I.

No significant electrical degradation was noted for the imaging member having charge transport compound reduction from 50 to 40 weight percent, nonetheless significant deleterious electrical functioning impact was observed with the use of a good electrical scanner as the loading level was reduced to 30 weight percent or below.

Example III

Four electrophotographic imaging members were prepared according to the procedures and using the same material as described in Example II, with the exception that the N,N'-diphenyl-N,N'-bis(3-methylphenyl)-1,1'-biphenyl-4,4'-diamine of Formula (I) utilized in the charge transport layer was replaced by a high hole mobility terphenyl diamine (stilbene) charge transport compound represented by:

FORMULA (II)

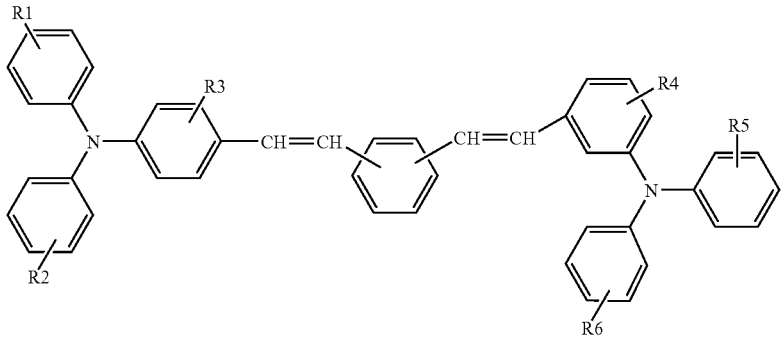

where R1, R2, R3, R4, R5, and R6 are each independently selected from hydrogen, halogen, an alkyl, an aryl, or a cyclo-alkyl group which have 1 to 18 carbon atoms, to give concentrations of 50, 40, and 30 weight percent in the MAKROLON binder based on the total weight of each resulting charge transport layer. These imaging members were then analyzed along with corresponding imaging member counterparts (each charge transport layer having respective 50, 40, and 30 percent by weight in polycarbonate) selected from Example II for photo-electrical function, to show that the drift mobility of imaging members having a charge transport layer prepared with this compound is approximately one order of magnitude higher than those of respective counterparts using N,N'-diphenyl-N,N'-bis(3-methylphenyl)-[1,1'-biphenyl]-4,4'-diamine of Formula (I).

Example IV

An imaging member web stock was prepared by following the procedures and using the same materials as described in the Control Example, but with the exception that the top layer of the dual charge transport layer was replaced with a 14 micrometer thick top transporting layer comprising 35 weight percent N,N'-diphenyl-N,N'-bis(3-methylphenyl)-1,1'-biphenyl-4,4'-diamine and 65 weight percent MAKROLON polymer binder.

Example V

Another imaging member web stock was prepared by following the procedures and using the same materials as described in Example IV, but with the exception that the top transporting layer of the dual charge transporting layer was replaced with another 14 micrometer thick top transporting-layer of this development to comprise 30 weight percent of the novel high mobility organic charge transport compound of Formula (II) described above and 70 weight percent MAKROLON polymer binder.

Mechanical and Print Testing Results

The imaging member web stocks of the Comparative Example, Control Example, Example IV, and Disclosure Example V were each cut to give rectangular sheets having precise dimensions of 440 millimeters width and 2,808 millimeters in length. Each cut imaging member sheet was ultrasonically welded in the long dimension to form a seamed flexible imaging member belt for dynamic fatigue electrophotographic imaging and print testing in a xerographic machine, employing a belt cycling module utilizing four 49 millimeter diameter, three 32.7 millimeter diameter, and one small 24.5 millimeter diameter belt support rollers. The belt cycling test results obtained showed that the control imaging member belt of Comparative and Control Examples I, both using 50 weight percent hole transport compound of Formula (I), quickly developed the generic fatigue induced charge transport layer cracking problem after about 35,000 print copies; whereas the onset of charge transport layer cracking was extended and became evident for the imaging member belts prepared from the imaging member web stocks, having a 35 weight percent Formula (I) top layer in the dual charge transporting layer of Example IV only until the print volume reached approximately 850,000 print out copies. It was interesting to note that the imaging member belt of Disclosure Example V, comprising 30 weight percent high hole mobility transport compound of Formula (II) in the top layer of the dual transport layer, had shown much greater resistance to dynamic belt charge transport layer cracking associated copy print defects far beyond 850,000 print volume.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

What is claimed is:

1. An imaging member comprising an electrically conductive supporting substrate or a supporting substrate comprising an electrically conductive layer;

an optional hole blocking layer;

a charge generating layer; and a charge transport layer having at least a first (bottom) charge transport layer and a second (top) charge transport layer each of which comprises a hole mobility organic transport compound molecularly dispersed in a film forming polymer binder;

wherein the first (bottom) charge transport layer comprises a hole mobility organic transport compound selected from the group consisting of triphenylmethane; bis(4-diethylamine-2-methylphenyl)phenylmethane; 4,4'-bis(diethylamino)-2,2'-dimethyltriphenyl-methane; N,N'-diphenyl-N,N'-bis(3-methylphenyl)-[1,1'-biphenyl]-4,4'-diamine; N,N'-diphenyl-N,N'-bis(4-methylphenyl)-[1,1'-biphenyl]-4,4'-diamine; N,N'-diphenyl-N,N'-bis(alkylphenyl)-1,1'-biphenyl-4,4'-diamine; N,N'-diphenyl-N,N'-bis(chlorophenyl)-1,1'-biphenyl-4,4'-diamine; tritolylamine; N,N'-bis-(3,4-dimethylphenyl)-4-biphenyl amine; N,N'-bis-(4-methylphenyl)-N,N'-bis(4-ethylphenyl)-1,1'-(3,3'-dimethylbiphenyl)-4,4'-diamine; N,N'-diphenyl-N,N'-bis(halophenyl)-1,1'-biphenyl-4,4'-diamine; N,N'-diphenyl-N,N'-bis(hydroxyphenyl)-1,1'-biphenyl-4,4'-diamine; phenanthrene diamine; arylamine; enamine; stilbene; and hydrazone molecules; and wherein the first (bottom) charge transport layer comprises between about 50 and about 90 weight percent hole mobility organic transport compound based on the total weight of the first (bottom) charge transport layer;

wherein the second (top) charge transport layer comprises a film forming polymer binder and a high hole mobility organic transport compound selected from the group consisting of a diamine represented by the formula:

FORMULA (II)

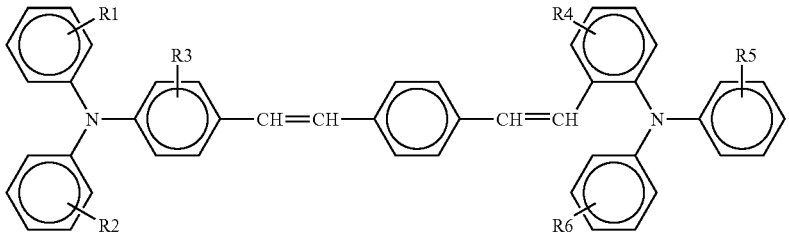

where R1, R2, R3, R4, R5, and R6 are independently selected from the group consisting of hydrogen, halogen, alkyl, aryl, and a cyclo-alkyl group having 1 to 18 carbon atoms, and at least one of R1, R2, R3, R4, R5, and R6 is halogen;

wherein the second (top) charge transport layer comprises a lesser amount by weight of this high hole mobility diamine organic transport compound than the hole transport compound used in the first (bottom) charge transport layer;

and wherein the film forming polymer binder is selected from the group consisting of polycarbonates, polystyrene, and poly(vinyl carbazole).

2. An imaging member according to claim 1, wherein the second (top) charge transport layer comprises between about 20 to about 45 weight percent of the high hole mobility diamine organic charge transport compound of Formula (II) based upon the total weight of the second charge transport layer.

3. An imaging member according to claim 1, wherein the second (top) charge transport layer comprises between about 30 to about 40 weight percent of the high hole mobility diamine organic charge transport compound of Formula (II) based upon the total weight of the second charge transport layer.

4. An imaging member according to claim 1, wherein the first (bottom) charge transport layer comprises between about 50 to about 70 weight percent of the hole mobility organic charge transport compound based upon the total weight of the first charge transport layer.

5. An imaging member according to claim 1, wherein the hole transport compound in the first (bottom) charge transport layer is comprised of an aryl amine, N,N'-diphenyl-N,N'-bis(alkylphenyl)-1,1'-biphenyl-4,4'-diamine, represented by:

FORMULA (I)

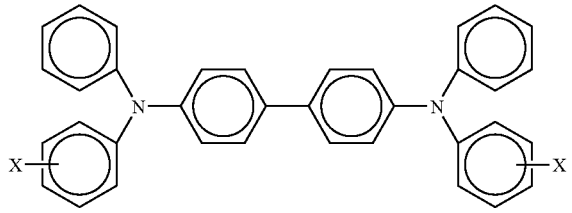

wherein X is selected from the alkyl group consisting of methyl.

6. An imaging member of claim 5, wherein the aryl diamine in the first (bottom) charge transport layer is N,N'-diphenyl-N,N'-bis(3-methylphenyl)-[1,1'-biphenyl]-4,4'-diamine.

7. An imaging member of claim 5, wherein the aryl diamine in the first (bottom) charge transport layer is N,N'-diphenyl-N,N'-bis(4-methylphenyl)-[1,1'-biphenyl]-4,4'-diamine.

8. An imaging member of claim 1, wherein the film forming binder used in the transport layers is a polycarbonate selected from the group consisting of poly(4,4'-isopropylidene diphenyl) carbonate and poly(4,4'-diphenyl)-1,1'-cyclohexane carbonate.

9. An imaging member of claim 1, wherein the film forming binder used in both transport layers is the same.

10. An imaging member comprising an electrically conductive supporting substrate or a supporting substrate comprising an electrically conductive layer;

an optional hole blocking layer;

a charge generating layer; and a dual charge transport layer having a first (bottom) and a second (top) charge transport layer each of which is a solid solution comprising a hole mobility organic transport compound molecularly dispersed or dissolved in a film forming polymer binder;

wherein the first (bottom) charge transport layer comprises a hole mobility organic transport compound selected from the group consisting of triphenylmethane; bis(4-diethylamine-2-methylphenyl)phenylmethane; 4,4'-bis(diethylamino)-2,2'-dimethyltriphenylmethane; N,N'-diphenyl-N,N'-bis(3-methylphenyl)-[1,1'-biphenyl]-4,4'-diamine; N,N'-diphenyl-N,N'-bis(4-methylphenyl)-[1,1'-biphenyl]-4,4'-diamine; N,N'-diphenyl-N,N'-bis(alkylphenyl)-1,1'-biphenyl-4,4'-diamine; N,N'-diphenyl-N,N'-bis(chlorophenyl)-1,1'-biphenyl-4,4'-diamine; tritolylamine; N,N'-bis-(3,4-dimethylphenyl)-4-biphenyl amine; N,N'-bis-(4-methylphenyl)-N,N'-bis(4-ethylphenyl)-1,1'-(3,3'-dimethylbiphenyl)-4,4'-diamine; N,N'-diphenyl-N,N'-bis(halophenyl)-1,1'-biphenyl-4,4'-diamine; N,N'-diphenyl-N,N'-bis(hydroxyphenyl)-1,1'-biphenyl-4,4'-diamine; phenanthrene diamine; arylamine; enamine; stilbene; and hydrazone molecules; and wherein the first (bottom) charge transport layer comprises between about 50 and about 90 weight percent hole mobility organic transport compound based on the total weight of the first (bottom) charge transport layer;

wherein the second (top) charge transport layer comprises a film forming polymer binder and a high hole mobility organic transport compound selected from the group consisting of a diamine represented by the formula:

FORMULA (II)

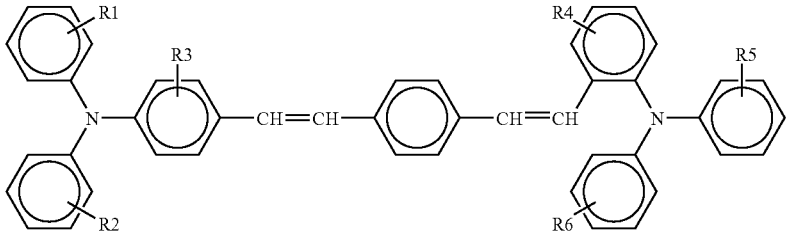

where R1, R2, R3, R4, R5, and R6 are independently selected from the group consisting of hydrogen, halogen, alkyl, aryl, and a cyclo-alkyl group having 1 to 18 carbon atoms, and at least one of R1, R2, R3, R4, R5, and R6 is halogen;

wherein the second (top) charge transport layer comprises a lesser amount by weight of this high hole mobility organic transport compound than the first (bottom) charge transport layer;

and wherein the film forming polymer binder is selected from the group consisting of polycarbonates, polystyrene, and poly(vinyl carbazole).

* * * * *

UNITED STATES PATENT AND TRADEMARK OFFICE

CERTIFICATE OF CORRECTION

PATENT NO. : 7,125,633 B2
APPLICATION NO. : 10/734380
DATED : October 24, 2006
INVENTOR(S) : Mishra et al.

It is certified that error appears in the above-identified patent and that said Letters Patent is hereby corrected as shown below:

TITLE PAGE, ITEM (75) INVENTORS:
DELETE "Yuh Yong" INSERT --Yuhua Tong--.

DELETE Inventor "Robert C. Yu".

Signed and Sealed this

Twelfth Day of June, 2007

JON W. DUDAS
*Director of the United States Patent and Trademark Office*